US008471661B2

(12) United States Patent
Sevakivi et al.

(10) Patent No.: US 8,471,661 B2
(45) Date of Patent: Jun. 25, 2013

(54) METHOD FOR MANUFACTURING COIL, AND A COIL

(75) Inventors: Pertti Sevakivi, Lepsama (FI); Markku Talja, Jarvenpaa (FI)

(73) Assignee: ABB Oy, Helsinki (FI)

( * ) Notice: Subject to any disclaimer, the term of this patent is extended or adjusted under 35 U.S.C. 154(b) by 343 days.

(21) Appl. No.: 12/789,964

(22) Filed: May 28, 2010

(65) Prior Publication Data

US 2011/0128105 A1 Jun. 2, 2011

(30) Foreign Application Priority Data

May 29, 2009 (FI) ..... 20095599
Dec. 17, 2009 (FI) ..... 20096346

(51) Int. Cl.
*H01F 5/00* (2006.01)

(52) U.S. Cl.
USPC ..... 335/300; 174/15.2; 174/15.5; 174/15.6

(58) Field of Classification Search
USPC ..... 335/216, 300; 174/15.1, 15.2, 15.4, 174/15.5, 15.6; 310/52, 54, 64
See application file for complete search history.

(56) References Cited

U.S. PATENT DOCUMENTS

| | | | |
|---|---|---|---|
| 5,886,434 A | 3/1999 | Nygard | |
| 6,741,152 B1 | 5/2004 | Arz et al. | |
| 2006/0028074 A1 | 2/2006 | Komura et al. | |

FOREIGN PATENT DOCUMENTS

| | | | |
|---|---|---|---|
| EP | 1 341 287 A2 | | 9/2003 |
| EP | 2 034 494 A2 | | 3/2009 |
| GB | 731299 A | | 6/1955 |
| GB | 735142 A | | 8/1955 |
| JP | 56150810 A | * | 11/1981 |
| JP | 60171704 A | * | 9/1985 |
| JP | 7-37714 A | | 2/1995 |

OTHER PUBLICATIONS

Finnish Search Report dated Jul. 5, 2010.
Finnish Search Report dated Jan. 20, 2010.

* cited by examiner

*Primary Examiner* — Ramon Barrera
(74) *Attorney, Agent, or Firm* — Buchanan Ingersoll & Rooney PC

(57) ABSTRACT

A coil includes electrically conductive winding wire wound in turns around a core in one or more layers. The surface of the winding wire is provided with at least one groove in the direction of the longitudinal axis of the winding wire, and at least one cooling tube which enables coolant circulation is positioned in the groove of the winding wire, being at least partly embedded therein. The groove is formed on the surface of the winding wire of an outermost winding wire layer relative to the core and opens away from the core The cooling tube in the groove is placed around the outermost winding wire layer and covers the outermost winding wire layer at least partly.

16 Claims, 2 Drawing Sheets

METHOD FOR MANUFACTURING COIL, AND A COIL

RELATED APPLICATIONS

This application claims priority under 35 U.S.C. §119 to Finnish Patent Application No. 20095599 filed in Finland on May 29, 2009, and Finnish Patent Application No. 20096346 filed in Finland on Dec. 17, 2009, the entire contents of each of which is hereby incorporated by reference in its entirety.

FIELD

The present disclosure relates to method of manufacturing a coil and to a coil structure.

BACKGROUND INFORMATION

A coil is an electrotechnical structure that is formed by winding an electrically conductive conductor, i.e. winding wire, in turns. Coils can be employed in connection with a plurality of electromagnetic and electromechanical devices. Examples of these devices include a choke, a transformer, a motor and a generator, all of which can include one or more coils.

A winding wire can be of any electrically conductive material, but various metal materials, such as copper and aluminium or alloys thereof, can be used, depending on the application for which the coil is intended. On the surface of the winding wire, there can be an insulating layer, such as a varnish, if the turns in the coil come into contact with one another. The cross-section of the winding wire can be round or rectangular, for example. FIG. 1 shows the cross-section of a rectangular winding wire 10.

When the coil is in use, an electric current passes therethrough and causes losses, which in turn heat the coil. In general, the coil can be cooled by air cooling, whereby excessive heat is conducted and radiates from the coil surfaces to the space surrounding the coil. Air cooling can be enhanced, when necessary, by a fan. However, air cooling of this kind may not provide a sufficient cooling effect in all conditions and applications. In addition, heat conducted and radiating from the coil to the space surrounding the coil can be harmful to other devices or structures in the vicinity of the coil, which may further increase the necessary cooling effect.

U.S. Pat. No. 6,741,152 discloses cooling a coil using cooling channels or cooling tubes, in which a coolant flows. The cooling channels or cooling tubes are placed inside coil conductors, which have at least two profiled conductor segments, or inside stranded conductors. Even though it can be possible to cool the coil by the disclosed solution, the solution does not necessarily reduce heat conduction and radiation to the space surrounding the coil.

SUMMARY

A method is provided for manufacturing a coil including electrically conductive winding wire. The method includes placing a cooling tube for coolant circulation in a groove provided in a surface of the winding wire and running substantially in a direction of a longitudinal axis of the winding wire such that the cooling tube will be embedded at least partly in the groove. The method also includes winding the winding wire and the cooling tube in turns around a core in one or more layers. An outermost winding wire layer is wound relative to the core such that the groove provided in the surface of the winding wire of the outermost winding wire layer opens away from the core, whereby the cooling tube placed in the groove is positioned around the outermost winding wire layer and covers the outermost winding wire layer at least partly.

A coil includes an electrically conductive winding wire which is wound in turns around a core in one or more layers. At least one groove running in a direction of a longitudinal axis of the winding wire is provided in a surface of the winding wire. At least one cooling tube for coolant circulation is located in the groove of the winding wire and embedded at least partly therein. The groove is provided in the surface of the winding wire of an outermost layer of the winding wire relative to the core and opens away from the core. The cooling tube placed in the groove is positioned around the outermost winding wire layer and covers the outermost winding wire layer at least partly.

BRIEF DESCRIPTION OF THE DRAWINGS

In the following, the disclosure will be described in greater detail in connection with exemplary embodiments, with reference to the attached drawings, in which.

DETAILED DESCRIPTION

The disclosure describes an exemplary method and an exemplary apparatus such that the above-mentioned and other problems can be solved or at least alleviated.

Exemplary embodiments of the present disclosure are based on the idea that a winding wire, whose outer surface is provided with a groove substantially in a direction of a longitudinal axis of the winding wire for receiving a cooling tube at least partly, can be wound into an outermost winding wire layer relative to a coil core such that the groove provided in the surface of the outermost winding wire layer opens substantially away from the core, for example, substantially outwardly from the coil, whereby the cooling tube placed in the groove can be positioned around the outermost winding wire layer and can cover the outermost winding wire layer at least partly.

Exemplary embodiments of the present disclosure advantageously provide that the cooling tube located on the outer edge of the coil and covering at least partly the heat-generating winding wires can effectively reduce heat conduction and radiation from the winding wires into the vicinity of the coil and consequently reduce the need for cooling the space surrounding the coil. For example, if the coil is located in an enclosed space, such as a device box, the need for cooling such a space can be reduced. Also, the cooling of the actual coil can be enhanced, when the coolant flows at least partly inside the winding wire. Solutions achieved by exemplary embodiments of the present disclosure are simple to implement and may be utilized in connection with both liquid cooling and gas cooling, for example.

Figure 1:
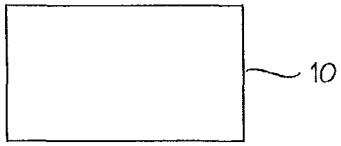
FIG. 1 is a cross-sectional view of an exemplary embodiment of a winding wire.
Figure 2:
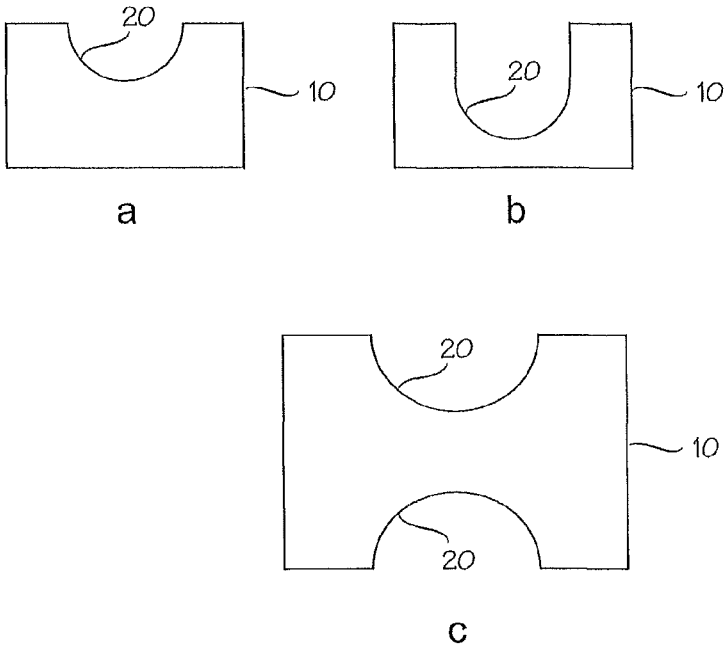
FIG. 2 shows cross-sectional views of a winding wire in accordance with alternative exemplary embodiments.

FIG. 2 shows three cross-sections 2*a*, 2*b* and 2*c* of a winding wire 10, which can be respectively provided with one or more grooves 20 in accordance with different embodiments. The appearance of the cross-section of the winding wire can deviate from the rectangular shape shown in the figures and it may be, for instance, round, rounded at the corners, triangular or of any other shape without deviating from the basic idea of the present disclosure. Further, the dimensions of the winding wire can be changed, when necessary. The groove 20 can be provided in the winding wire 10 already during manufacturing or in a subsequent, separate step. On the outer surfaces of the winding wire 10, there can be provided an enamel varnish insulating the turns or another insulating layer. The material of the winding wire is not relevant to the basic idea of the present disclosure and it can be, for example, metal, such as copper or aluminium, or some other electrically conductive material, depending on the use. In FIG. 2*a*, the cross-section shows a winding wire on one exterior face of which there can be provided a substantially semicircular groove 20. The groove 20 can extend, for example, throughout the entire length of the winding wire substantially in the direction of the longitudinal axis of the winding wire. In FIG. 2*b*, the cross-section shows a winding wire on one exterior face of which there can be provided a deepened groove 20 having a semicircular bottom. It is to be noted that the cross-sectional shape of the groove 20 can deviate from the examples shown in the figures and, for example, its shape can be at least partly a circular arch, a rectangle, a v-shape or some other shape. The number of grooves 20 can also be more than one. In FIG. 2*c*, the cross-section shows a winding wire 10 with grooves 20 provided on the two mutually opposite exterior faces thereof. The purpose of the groove or grooves 20 is to enable placement of a cooling tube, which enables circulation of a coolant, at least partly inside the winding wire 10. For example, the cross-sectional shape of the outer surface of the cooling tube corresponds at least partly to the shape of the inner surface of the groove 20, whereby heat can be transmitted from the winding wire to the coolant flowing inside the cooling tube. The cooling tube can be made of a deformable material. The cooling tube can be made of metal material, plastic material, rubber material or a combination thereof, for example. The coolant may be, for example, a liquid substance, such as water, or a gaseous substance, such as air. When a metal cooling tube is used, the cooling liquid becomes live unless deionized liquid is used.

Figure 3:
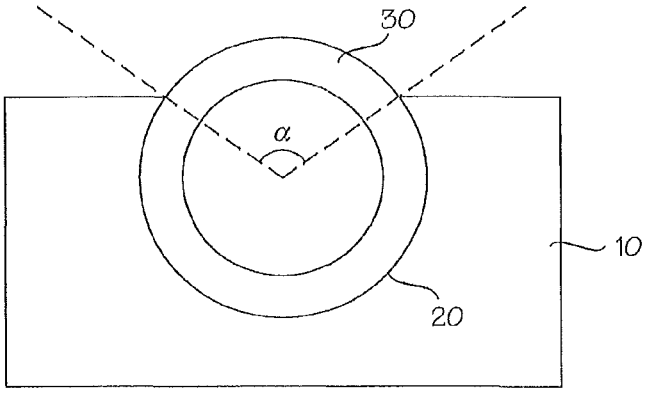
FIG. 3 is a cross-sectional view of a winding wire in accordance with an exemplary embodiment.

In accordance with an exemplary embodiment, the cross-section of the at least one groove 20 in the winding wire 10 can be substantially a circular arch in a shape such that the central angle corresponding to the circular arch exceeds 180 degrees, whereby the groove 20 locks the cooling tube inserted in the groove into place. An advantage of the locking is, for example, that the cooling tube can be mounted, if so desired, in the groove of the winding wire in a preliminary step already, prior to the actual winding. In FIG. 3, the cross-section shows a winding wire 10 in which the provided groove 20 can be a circular arch in a shape such that the central angle $\alpha$ corresponding to the circular arch exceeds 180 degrees. In that case the groove 20 locks the cooling tube 30 inserted in the groove into place. The central angle corresponding to the groove 20 may vary within the range of $180° < \alpha < 360°$, for example, if it is desired to be locking. An appropriate value of the central angle corresponding to the groove can be, for example, about 90 degrees like in the example of FIG. 3. The larger the central angle, the more efficient the locking. On the other hand, the mounting of the tube 30 into the groove 20 can be easier, the smaller the central angle $\alpha$. Thus, the appropriate width of the central angle $\alpha$ should be selected, for example, on the basis of the elasticity of the material of the cooling tube 30 and/or other component characteristics.

According to an exemplary embodiment of the present disclosure, a coil can be formed of a grooved winding wire by mounting a cooling tube 30, which enables coolant circulation, in a groove 20 provided on the outer surface of the winding wire 10 such that the cooling tube will be embedded at least partly in the groove and the winding wire 10, and the cooling tube 30 can be wound in turns around the core in one or more layers. The outermost layer of the winding wire 10 relative to the core can be, for example, wound such that the groove 20 provided in the surface of the winding wire in the outermost winding wire layer opens away from the core, whereby the cooling tube 30 placed in the groove can be positioned around the outermost winding wire layer and cover the outermost winding wire layer at least partly. According to an exemplary embodiment, the mounting of the cooling tube 30 into the groove 20 of the winding wire 10 takes place prior to the winding in turns. According to another exemplary embodiment, the mounting of the cooling tube 30 into the groove 20 of the winding wire 10 can take place substantially simultaneously with the winding in turns.

Figure 4:
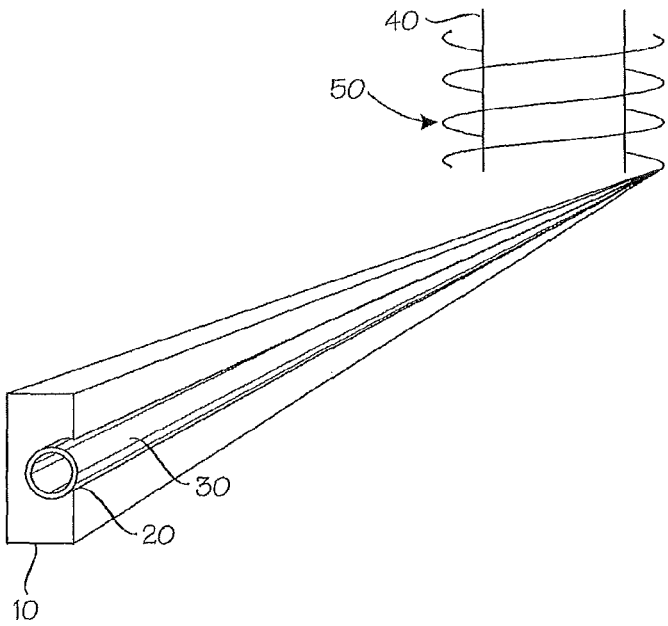
FIG. 4 shows a coil in accordance with an exemplary embodiment.

FIG. 4 shows an example of a coil 50 which includes turns of winding wire 10 wound around a core 40. A groove 20 can be provided in the surface of the winding wire 10. Further, the coil 50 includes a cooling tube 30 which runs in the groove 20 and can be partly embedded therein. The groove 20 may have any of the shapes shown in FIG. 2 or 3, or some other shape. The exact structure of the coil, such as the material of the core 40, is not relevant to the basic idea of the present disclosure, but can be selected according to a particular use. The core 40 may be an air core, or made of magnetic material, for example. The optional air core may include an appropriate support structure, around which the winding wires 10 are wound. In the example of FIG. 4, the coil 50 includes just one layer of winding wire 10 around the core 40, and consequently this single winding wire layer constitutes at the same time the outermost winding wire layer relative to the core 40. A groove 20 provided in the surface of this outermost winding wire layer relative to the core 40 opens away from the core 40, whereby the cooling tube 30 placed in the groove can be positioned around the outermost winding wire layer and cover the outermost winding wire layer partly. When the cross section of the winding wire 10 is rectangular, as in the example of FIG. 4, the groove 20 in the outermost winding wire layer can be located on the side of the wire facing away from the core 40 and thus the groove opens away from the core. The proportion of the widths of the grooved side of the winding wire 10 and of the cooling tube 30 may differ from those shown in FIG. 4, and the cooling tube may be narrower or wider than the one shown in FIG. 4. If the cooling tube 30 is at least as wide as the grooved side of the winding wire 10, the cooling tube may cover the outermost winding wire layer even completely, whereby heat conduction and radiation from the winding wires to the vicinity will be reduced as effectively as possible. The coil 50 may include more than one winding wire layer, which layers are placed between the outermost winding wire layer of the figure and the core. Likewise, there may be a plurality of cooling tubes 30.

Figure 5:
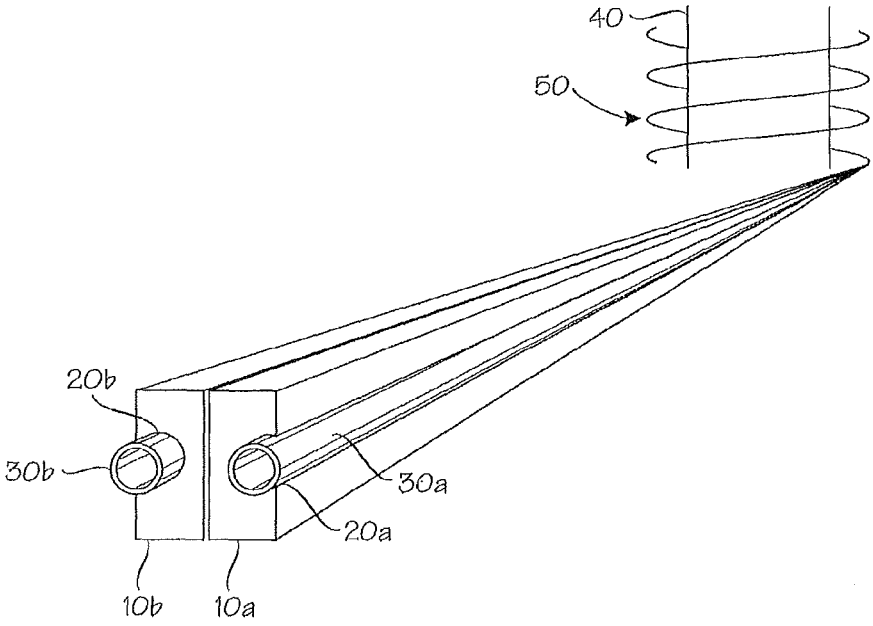
FIG. 5 shows a coil in accordance with an exemplary embodiment.

According to an exemplary embodiment of the present disclosure, at least two layers of winding wire and cooling tube can be wound in turns around the core. In this exemplary arrangement, the innermost layer of the winding wire relative to the core can be, for example, wound such that a groove provided in the surface of the innermost winding wire layer opens towards to the core, whereby the cooling tube in the groove can be placed between the innermost winding wire layer and the core. FIG. 5 shows an example of a coil 50 that includes wire turns in two layers wound of winding wires 10*a* and 10*b* around the core 40. In the surfaces of the winding wires 10*a* and 10*b* there are provided grooves 20*a* and 20*b*, respectively. The coil 50 includes cooling tubes 30*a* and 30*b*, which run in the grooves 20*a* and 20*b*, respectively. The groove 20*a* provided in the surface of the winding wire 10*a* in the outermost winding wire layer relative to the core 40 opens away from the core 40. Correspondingly, the groove 20*b* provided in the surface of the winding wire 10*b* in the innermost winding wire layer relative to the core 40 opens towards the core 40, whereby the cooling tube 30*b* placed in the groove 20*b* can be positioned between the innermost winding wire layer and the core 40. The core material can include appropriate cuts or grooves, in which the innermost cooling tube 30*b* can be partly embedded. The coil 50 can include more than two winding wire layers, which can be positioned between the outermost and the innermost winding wire layers shown in the figure. Likewise, there may be more than two cooling tubes. The grooves in the winding wires of different winding wire layers 10*a*, 10*b* may also be different. The coil, for example as shown in FIG. 5, may be produced by winding all four components, for example both winding wires 10*a* and 10*b* as well as both cooling tubes 30*a* and 30*b*, substantially simultaneously around the coil core 40. Alternatively, the inner cooling tube 30*b* may be first wound around the core 40 and thereafter the winding wires 10*a* and 10*b* are wound together or separately on the inner cooling tube, and finally, the outermost cooling tube 30*a* is wound on the winding wires.

Figure 6:
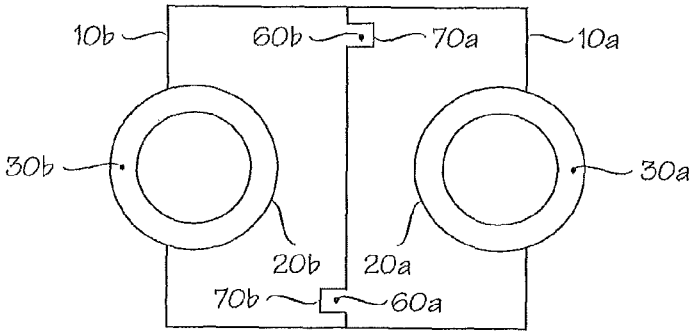
FIG. 6 shows a cross-sectional view of winding wires in accordance with an exemplary embodiment.

According to an exemplary embodiment of the present disclosure, the at least one groove, which holds the cooling tube, can be provided on one side of the winding wire, and on the opposite side of the winding wire there can be provided at least one second groove and/or at least one rib. FIG. 6 shows an example, where that side of the winding wires 10*a* and 10*b*, which is opposite to the one including the groove 20*a*, 20*b* for receiving the cooling tube 30*a* 30*b*, can be provided with second grooves 70*a* and 70*b* and ribs 60*a* and 60*b*. When the winding wires 10*a* and 10*b* are wound in two layers such that the sides of winding wires in different layers, which sides are provided with the at least one second groove 70*a* and 70*b* and/or the at least one rib 60*a* and 60*b*, are facing one another, as shown in FIG. 6, the ribs advantageously extend into the second grooves and thus mutually align the winding wires in different layers. It is also possible that just one winding wire 10*a* or 10*b* includes a second groove 70*a* or 70*b*, and correspondingly, just one of the winding wires 10*a* or 10*b* includes a rib 60*a* or 60*b*, by which the winding wires can be mutually aligned in winding. There can also be more than two grooves and/or ribs and their locations may deviate from what is presented above.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for manufacturing a coil including electrically conductive winding wire, the method comprising:

placing a cooling tube for coolant circulation, in a groove provided in a surface of the winding wire and running substantially in a direction of a longitudinal axis of the winding wire such that the cooling tube will be embedded at least partly in the groove; and winding the winding wire and the cooling tube in turns around a core in at least two layers, wherein an outermost winding wire layer is wound relative to the core such that the groove provided in the surface of the winding wire of the outermost winding wire layer opens away from the core, whereby the cooling tube placed in the groove is positioned around the outermost winding wire layer and covers the outermost winding wire layer at least partly; and winding an innermost layer of the winding wire relative to the core such that the groove provided in the surface of the winding wire in the innermost layer opens towards the core, and the cooling tube placed in the groove is positioned between the innermost winding wire layer and the core.

2. The method of claim 1, wherein the placement of the cooling tube in the groove of the winding wire is carried out prior to the winding in turns.

3. The method of claim 1, wherein the placement of the cooling tube in the groove of the winding wire is carried out substantially simultaneously with the winding in turns.

4. The method of claim 1, wherein the at least one groove is provided substantially throughout an entire length of the winding wire.

5. A coil comprising:

an electrically conductive winding wire which is wound in turns around a core in one or more layers, and which has, in a surface of the winding wire, at least one groove running in a direction of a longitudinal axis of the winding wire; and at least one cooling tube for coolant circulation and which is located in the groove of the winding wire and embedded at least partly therein, wherein the groove provided in the surface of the winding wire of an outermost layer of the winding wire relative to the core opens away from the core, whereby the cooling tube placed in said groove is positioned around the outermost winding wire layer and covers the outermost winding wire layer at least partly;

wherein the winding wire and the cooling tube are wound in at least two layers around the core such that the groove provided in the surface of the winding wire in an innermost winding wire layer opens towards the core, wherein the cooling tube placed in the groove is positioned between the innermost winding wire layer and the core.

6. The coil of claim 5, wherein the at least one groove is provided substantially throughout an entire length of the winding wire.

7. The coil of claim 5, wherein a cross-section of the at least one groove is at least partly a circular arch in shape.

8. The coil of claim 5, wherein an exterior face of a cross-sectional shape of the cooling tube corresponds at least partly to the cross-sectional shape of the groove.

9. The coil of claim 7, wherein the cross-section of the at least one groove is substantially a circular arch in shape such that a central angle corresponding to the circular arch exceeds 180 degrees, whereby the groove locks the cooling tube placed in the groove into place.

10. The coil of claim 5, wherein a cross-section of the winding wire is substantially rectangular in shape.

11. The coil of claim 10, wherein the at least one groove, which holds the cooling tube, is provided on one side of the winding wire, and on an opposite side of the winding wire there is provided at least one second groove and/or at least one rib.

12. The coil of claim 11, wherein the winding wire is wound in two layers around the core such that sides of the winding wires in different layers which are provided with at least one second groove and/or at least one rib are facing one another, whereby the ribs extend into the second grooves mutually aligning the winding wires in different layers.

13. The coil of claim 5, wherein the cooling tube is made of deformable material.

14. The coil of claim 5, wherein the cooling tube is made of at least one of a metal material, plastic material, and rubber material.

15. The coil of claim 5, wherein the coolant is at least one of a liquid substance and a gaseous substance.

16. The coil of claim 5, wherein the core of the coil is one of an air core and made of magnetic material.

* * * * *

UNITED STATES PATENT AND TRADEMARK OFFICE

CERTIFICATE OF CORRECTION

PATENT NO. : 8,471,661 B2
APPLICATION NO. : 12/789964
DATED : June 25, 2013
INVENTOR(S) : Pertti Sevakivi et al.

It is certified that error appears in the above-identified patent and that said Letters Patent is hereby corrected as shown below:

Delete the title page and substitute therefore with the attached title page showing the corrected number of claims in the patent.

In the Claims

Column 6, line 62 (What is Claimed is) Please insert claim, -- 17. The coil of claim 8, wherein the cross-section of the at least one groove is substantially a circular arch in shape such that a central angle corresponding to the circular arch exceeds 180 degrees, whereby the groove locks the cooling tube placed in the groove into place. --.

Signed and Sealed this
Twenty-fifth Day of February, 2014

Michelle K. Lee

Michelle K. Lee
*Deputy Director of the United States Patent and Trademark Office*

(12) United States Patent
Sevakivi et al.

(10) Patent No.: US 8,471,661 B2
(45) Date of Patent: Jun. 25, 2013

(54) METHOD FOR MANUFACTURING COIL, AND A COIL

(75) Inventors: Pertti Sevakivi, Lepsama (FI); Markku Talja, Jarvenpaa (FI)

(73) Assignee: ABB Oy, Helsinki (FI)

( * ) Notice: Subject to any disclaimer, the term of this patent is extended or adjusted under 35 U.S.C. 154(b) by 343 days.

(21) Appl. No.: 12/789,964

(22) Filed: May 28, 2010

(65) Prior Publication Data

US 2011/0128105 A1 Jun. 2, 2011

(30) Foreign Application Priority Data

May 29, 2009 (FI) ..... 20095599
Dec. 17, 2009 (FI) ..... 20096346

(51) Int. Cl.
*H01F 5/00* (2006.01)

(52) U.S. Cl.
USPC ..... 335/300; 174/15.2; 174/15.5; 174/15.6

(58) Field of Classification Search
USPC ..... 335/216, 300; 174/15.1, 15.2, 15.4, 174/15.5, 15.6; 310/52, 54, 64
See application file for complete search history.

(56) References Cited

U.S. PATENT DOCUMENTS

| | | | |
|---|---|---|---|
| 5,886,434 | A | 3/1999 | Nygard |
| 6,741,152 | B1 | 5/2004 | Arz et al. |
| 2006/0028074 | A1 | 2/2006 | Komura et al. |

FOREIGN PATENT DOCUMENTS

| | | | | |
|---|---|---|---|---|
| EP | 1 341 287 | A2 | | 9/2003 |
| EP | 2 034 494 | A2 | | 3/2009 |
| GB | 731299 | A | | 6/1955 |
| GB | 735142 | A | | 8/1955 |
| JP | 56150810 | A | * | 11/1981 |
| JP | 60171704 | A | * | 9/1985 |
| JP | 7-37714 | A | | 2/1995 |

OTHER PUBLICATIONS

Finnish Search Report dated Jul. 5, 2010.
Finnish Search Report dated Jan. 20, 2010.

* cited by examiner

*Primary Examiner* — Ramon Barrera
(74) *Attorney, Agent, or Firm* - Buchanan Ingersoll & Rooney PC

(57) ABSTRACT

A coil includes electrically conductive winding wire wound in turns around a core in one or more layers. The surface of the winding wire is provided with at least one groove in the direction of the longitudinal axis of the winding wire, and at least one cooling tube which enables coolant circulation is positioned in the groove of the winding wire, being at least partly embedded therein. The groove is formed on the surface of the winding wire of an outermost winding wire layer relative to the core and opens away from the core The cooling tube in the groove is placed around the outermost winding wire layer and covers the outermost winding wire layer at least partly.

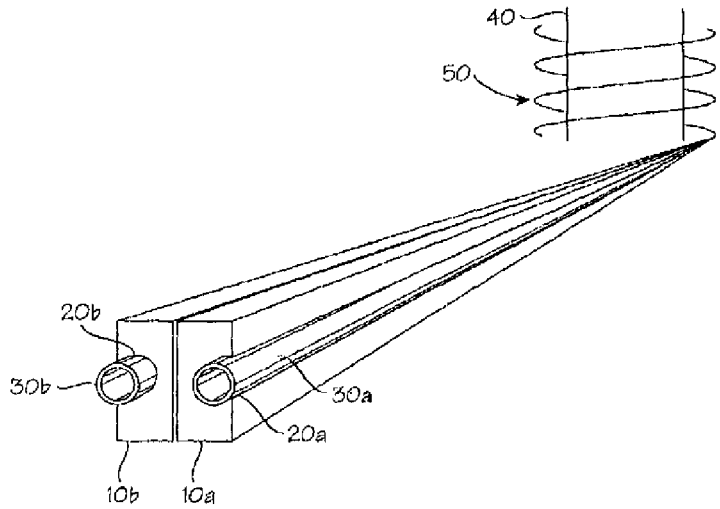

17 Claims, 2 Drawing Sheets